US008388367B2

(12) United States Patent
Nonen et al.

(10) Patent No.: US 8,388,367 B2
(45) Date of Patent: Mar. 5, 2013

(54) DIRECT ATTACH CABLE

(75) Inventors: Hideki Nonen, Hitachi (JP); Takahiro Sugiyama, Hitachi (JP); Ryuta Takahashi, Hitachi (JP)

(73) Assignee: Hitachi Cable, Ltd., Tokyo (JP)

( * ) Notice: Subject to any disclaimer, the term of this patent is extended or adjusted under 35 U.S.C. 154(b) by 0 days.

(21) Appl. No.: 13/137,482

(22) Filed: Aug. 19, 2011

(65) Prior Publication Data

US 2012/0064754 A1 Mar. 15, 2012

(30) Foreign Application Priority Data

Sep. 13, 2010 (JP) ..... 2010-204504

(51) Int. Cl.
*H01R 13/627* (2006.01)

(52) U.S. Cl. ..... 439/358; 439/352

(58) Field of Classification Search ..... 439/352, 439/372, 358
See application file for complete search history.

(56) References Cited

U.S. PATENT DOCUMENTS 6,371,787 B1 * 4/2002 Branch et al. ..... 439/352
6,431,887 B1 * 8/2002 Yeomans et al. ..... 439/108
6,439,918 B1 8/2002 Togami et al.
6,786,653 B1 * 9/2004 Hwang et al. ..... 385/92
6,805,573 B2 10/2004 Phillips et al.
6,881,095 B2 * 4/2005 Murr et al. ..... 439/607.2
7,090,527 B2 * 8/2006 Hanley et al. ..... 439/372
7,351,090 B1 * 4/2008 Moore ..... 439/372
7,364,446 B2 * 4/2008 Kurashima ..... 439/157
7,402,070 B1 * 7/2008 Wu ..... 439/352
7,416,353 B2 * 8/2008 Yoshikawa et al. ..... 385/92
7,549,886 B2 * 6/2009 Herring et al. ..... 439/352
7,680,389 B2 * 3/2010 Shaw et al. ..... 385/139
7,824,208 B2 * 11/2010 Crofoot et al. ..... 439/352
7,901,226 B2 * 3/2011 Kotaka ..... 439/160
7,955,003 B2 * 6/2011 Teo et al. ..... 385/92
8,047,865 B2 * 11/2011 Patel et al. ..... 439/499
8,064,207 B2 * 11/2011 Wu ..... 361/747

* cited by examiner

*Primary Examiner* — Briggitte R Hammond
(74) *Attorney, Agent, or Firm* — McGinn IP Law Group, PLLC

(57) ABSTRACT

A direct attach cable includes a cable connected to a paddle card, a housing formed to store the paddle card and the end portion of the cable, a latch engaged with an engaging portion of a plate spring provided on the cage when the housing is inserted in the cage, a de-latching lever in a lever shape for releasing the engagement between the latch and the plate spring, the de-latching lever pushing up the plate spring to disengage the engaging portion of the plate spring from the latch, a link formed in a frame shape so as to be fitted to the housing on the rear end side in the insertion direction, the link pushing up the plate spring via the de-latching lever by moving toward the rear end side, and a pull-tab for moving the link on the rear end side of the housing in the insertion direction.

6 Claims, 8 Drawing Sheets

DIRECT ATTACH CABLE

The present application is based on Japanese Patent Application No. 2010-204504 filed on Sep. 13, 2010, the entire contents of which are incorporated herein by reference.

BACKGROUND OF THE INVENTION

1. Field of the Invention

The invention relates to a direct attach cable for being directly connected to a device.

2. Description of the Related Art

As a conventional cable used for inter-device connection, there is a direct attach cable provided with a cable of which end portion is connected to a paddle card, and a housing (module) formed to store the paddle card as well as the end portion of the cable and to be insertable into and extractable from a cage as a connection target of the paddle card.

In this direct attach cable, the housing located at the end portion is inserted into a cage provided to a device, thereby electrically connecting the paddle card in the housing to a connecting terminal in the cage.

If the housing is pulled out from the cage during operation of the device, signal communication is interrupted or the device sometimes breaks down, therefore, the direct attach cable is provided with a latch to prevent such a problem.

The latch has a structure in which the housing is engaged with an engaging portion provided on the cage at the time of insertion so that the housing is not accidentally pulled out from the cage. In addition, it is configured that the engagement between the engaging portion and the latch is released by operating a de-latching (i.e., release of a latch) mechanism provided on the housing or the cage for pulling the housing out from the cage.

For example, U.S. Pat. No. 6,805,573 discloses in the specification that a mechanism in which a latch is retracted on a housing side by operating a lever having the latch formed thereon to release a latched state.

In this mechanism for providing a de-latched state by retracting the latch on the housing side, it is necessary to use a link having a rotation center, such as a lever, in order to provide the de-latched state.

However, a direct attach cable has a problem in that a lever mechanically interferes with a cable since the cable is directly drawn from a housing, resulting in that it is not possible to obtain sufficient stroke to provide a de-latched state.

In addition, this mechanism requires two processes, one of which is a process for providing a de-latched state by operating a lever and another of which is a process for pulling the housing out from the cage, for releasing the connection to the device, which is cumbersome.

Therefore, it is desirable that the de-latching mechanism is activated at the same time as applying a force for pulling out the housing when the direct attach cable is detached from the device. In addition, it is desirable that a component for applying a housing pulling force is located on a surface opposite to the latch in view of a mounting state of the housing on a transmission equipment, i.e., a state in which surfaces having latches provided thereon are arranged to face each other.

In order to realize this, a structure using a pull-tab and a link is generally employed, such as a mechanism in which a link (component) having a rotation shaft at a center of a housing is rotated by operating a pull-tab from a surface side opposite to a surface having a latch provided thereon to push up an engaging portion provided on a cage, thereby releasing a latched state (see, e.g., the specification of U.S. Pat. No. 6,439,918).

SUMMARY OF THE INVENTION

However, in the mechanism disclosed in the specification of U.S. Pat. No. 6,439,918, a sufficiently stable de-latched state may not be obtained by a housing pulling force depending on a link connecting a pull-tab to a latch.

In detail, since the rotation shaft is provided at the center of the link, a ratio of a pull-tab pulling force to an engagement portion pushing force is 1:1, and thus, stable de-latching is not possible. Even if the position of the rotation shaft is shifted from the center, more pull-tab pulling force may be required or the push-up amount may decrease, and after all, it is not possible to provide a stable de-latched state. Therefore, it is an object of the invention to provide a direct attach cable for providing a sufficiently stable de-latched state by a housing pulling force.

(1) According to one embodiment of the invention, a direct attach cable comprises:

a cable that an end portion thereof is connected to a paddle card;

a housing formed to store the paddle card and the end portion of the cable and to be insertable into and extractable from a cage as a connection target of the paddle card, the housing having a square cross section in a direction perpendicular to an insertion direction;

a latch formed into a wedge shape protruding on one surface of the housing on a rear end side in the insertion direction and engaged with an engaging portion of a plate spring provided on the cage when the housing is inserted in the cage;

a de-latching lever in a lever shape for releasing the engagement between the latch and the plate spring, the de-latching lever being provided posterior to the latch of the housing in the insertion direction and pushing up the plate spring to disengage the engaging portion of the plate spring from the latch;

a link formed in a frame shape so as to be fitted to the housing on the rear end side in the insertion direction and so that an inner surface thereof surrounds the de-latching lever on the effort side, the link pushing up the plate spring via the de-latching lever by moving toward the rear end side in the insertion direction; and a pull-tab for moving the link on the rear end side of the housing in the insertion direction.

In the above embodiment (1) of the invention, the following modifications and changes can be made.

(i) The de-latching lever comprises an inclined surface inclined toward a front end side in the insertion direction at an effort side end portion thereof, and the inner surface of the link climbs on the inclined surface of the de-latching lever by movement of the pull-tab toward the rear end side in the insertion direction, thereby pushing the effort side end portion of the de-latching lever in a direction coming close to the housing and pushing up the plate spring.

(ii) The direct attach cable further comprises a compression coil spring for applying a force to the effort side end portion of the de-latching lever in a direction going away from the housing, the compression coil spring being provided between the de-latching lever and the one surface of the housing.

(iii) The direct attach cable further comprises an extension coil spring for applying a force to the link in a direction coming close to the housing, the extension coil spring being provided between the link and an end surface of the housing on the rear end side in the insertion direction.

(iv) The extension coil springs are symmetrically arranged on the end surface of the housing on the rear end side in the insertion direction along a direction parallel to the one surface of the housing so as to sandwich the cable.

(v) The de-latching lever further comprises a rotation shaft that is arranged anterior to a center of the de-latching lever in the insertion direction such that a force acting on a point of load is larger than a force applied to the point of effort.

Points Of The Invention

According to one embodiment of the invention, a direct attach cable is constructed such that a link for contacting a de-latching lever sandwiched between a housing and the link is pulled according as a pull-tab is pulled by hand. Here, the link pulled presses (or forces downward) the point of effort of the de-latching lever toward the housing while contacting the de-latching lever, whereby the de-latching lever applies to the point of load thereof a force larger than the pressing force due to the principle of leverage. Thus, the force for pulling the pull-tab can be smoothly transmitted to the de-latching system, so that a stable (or secure) de-latched state can be provided. In addition, the de-latching and the pulling of the housing (i.e., the removal of the housing from a cage to which the direct attach cable is latched) can be simply conducted only by pulling the pull-tab. Furthermore, the de-latching can be conducted without causing the cable to mechanically interfere with the de-latching lever.

BRIEF DESCRIPTION OF THE DRAWINGS

Next, the present invention will be explained in more detail in conjunction with appended drawings, wherein.

DETAILED DESCRIPTION OF THE PREFERRED EMBODIMENTS

A preferred embodiment of the invention will be described below in conjunction with the appended drawings.

Figure 1:
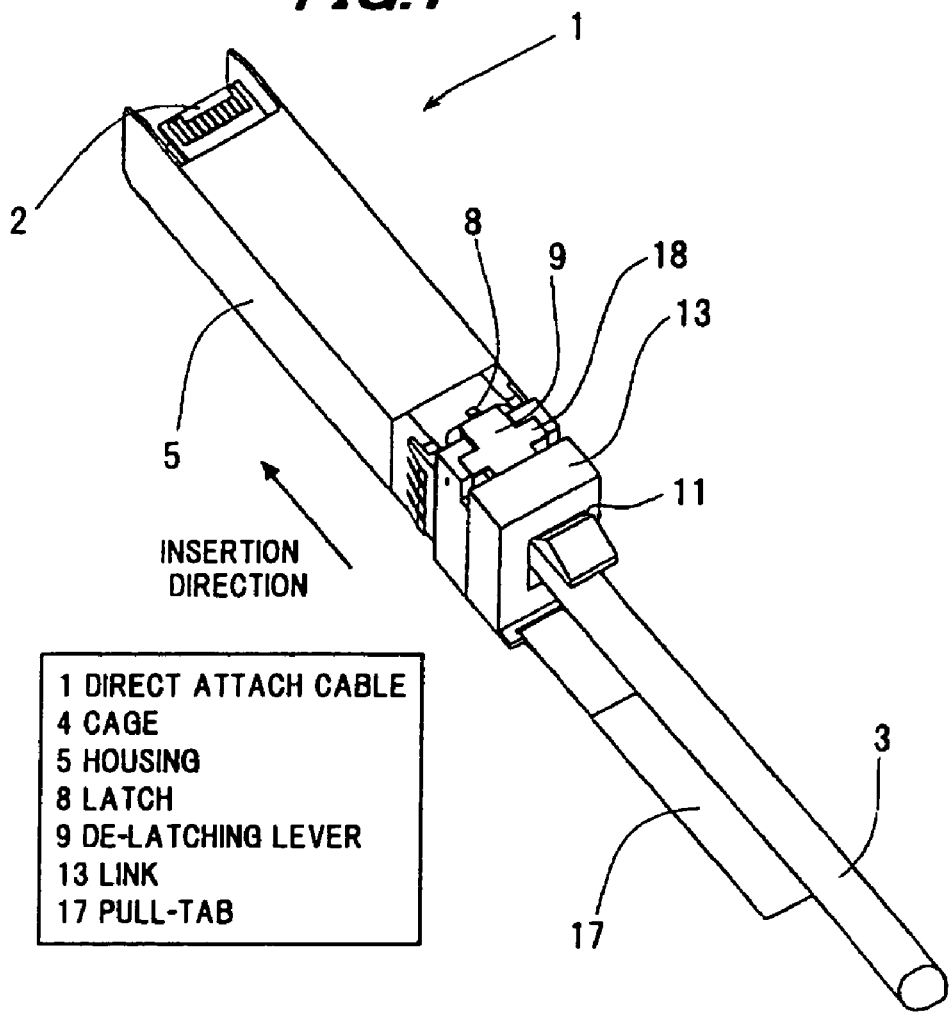
FIG. 1 is a perspective view showing a direct attach cable in an embodiment of the present invention.
Figure 2:
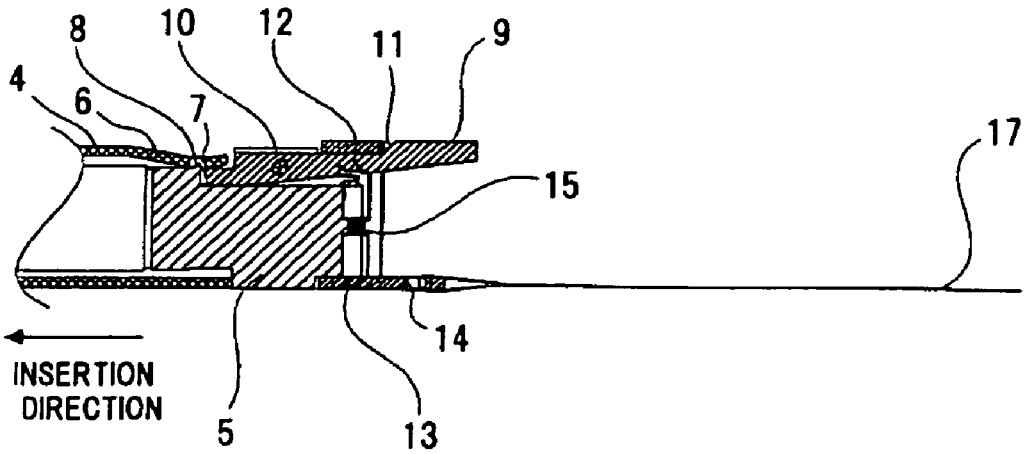
FIG. 2 is a cross sectional view in an insertion direction showing the direct attach cable of FIG. 1 in a state that a housing is inserted into a cage.

FIG. 1 is a perspective view showing a direct attach cable in an embodiment of the invention. FIG. 2 is a cross sectional view in an insertion direction showing the direct attach cable of FIG. 1 in a state that a housing is inserted into a cage.

As shown in FIGS. 1 and 2, a direct attach cable 1 in the present embodiment is mainly provided with a cable 3 of which end portion is connected to a paddle card 2, and a housing 5 which is formed to store the paddle card 2 as well as the end portion of the cable 3 and to be insertable into and extractable from a cage 4 as a connection target of the paddle card 2 and has a square cross section in a direction perpendicular to the insertion direction.

The paddle card 2 is inserted into a non-illustrated receiving connector provided in the cage 4 to be electrically connected to a connecting terminal of a device, and the cable 3 is, e.g., an insulated cable formed by coating an outer periphery of a copper wire with an insulation layer.

The cage 4 has a plate spring 6 which is itself formed in a plate-spring shape. Meanwhile, the cross-sectional shape and dimension of the housing 5 in a direction perpendicular to the insertion direction are defined by standards and are configured to meet the standards.

A latch 8, which is engaged with an engaging portion 7 of the plate spring 6 integrally provided with the cage 4, is formed on one surface (an upper surface in the drawing) of the housing 5. The latch 8 is formed to have a wedge shape protruding on the housing 5 on a rear end side in the insertion direction (right front in the drawing), and is engaged with the engaging portion 7 when the housing 5 is inserted into the cage 4.

Figure 3:
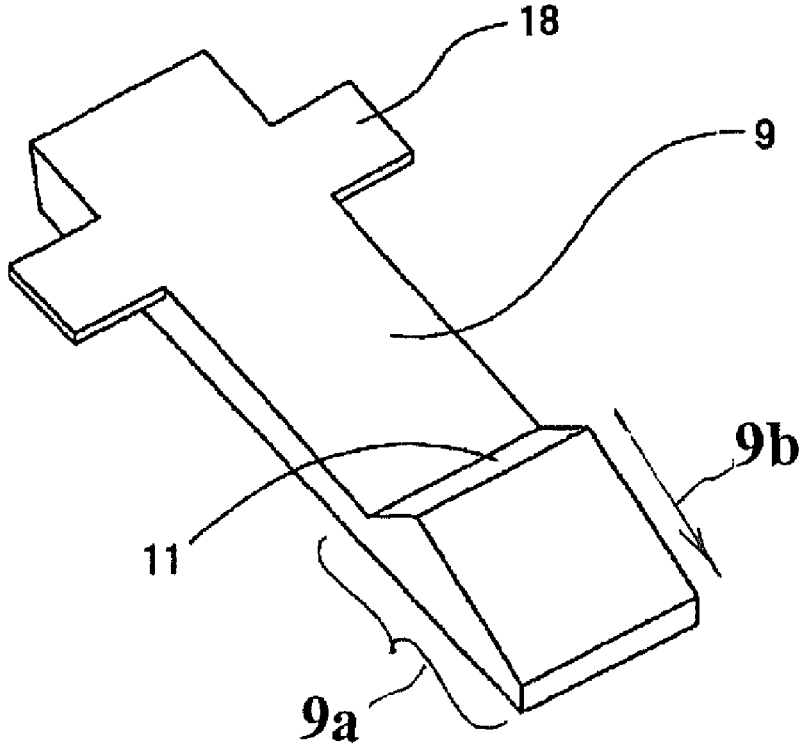
FIG. 3 is a perspective view showing a de-latching lever.
Figure 4:
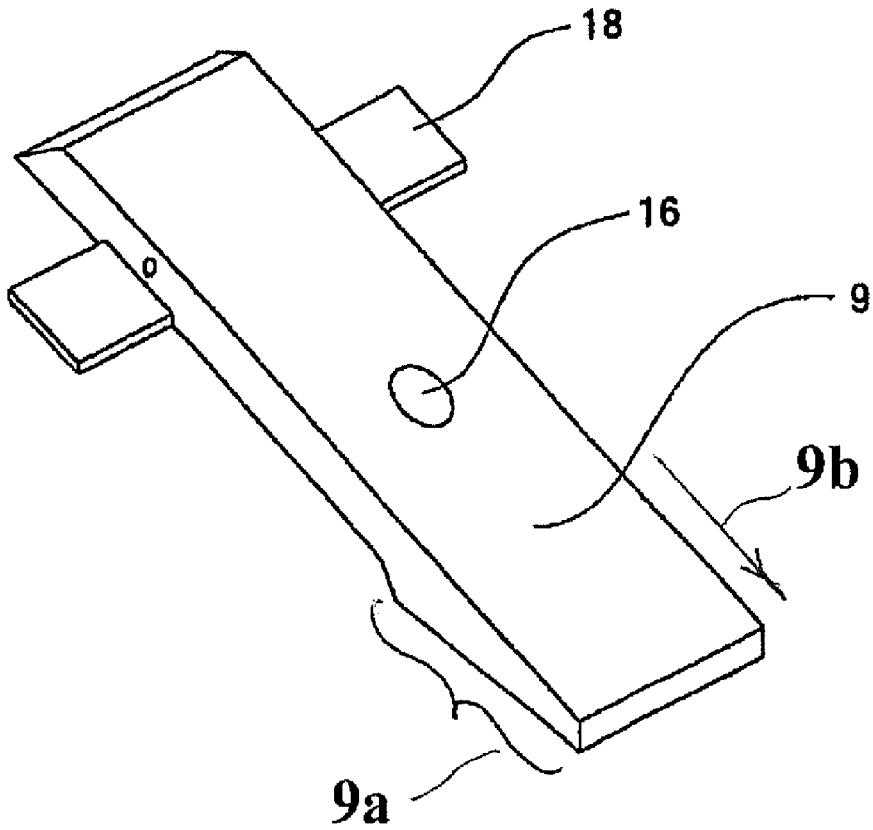
FIG. 4 is a perspective view showing the de-latching lever.

Meanwhile, a de-latching lever 9 in a lever shape for pushing up the plate spring 6 to disengage the engaging portion 7 from the latch 8 is provided posterior to the latch 8 of the housing 5 in the insertion direction in order to release the engagement between the latch 8 and the engaging portion 7 (see FIGS. 3 and 4).

The de-latching lever 9 is formed in a seesaw shape of which rotation shaft is a shaft 10, and is configured so that an end portion on the rear end side in the insertion direction is a point of effort and an end portion on the front end side in the insertion direction is a point of load, where the shaft 10 is a pivot (fulcrum point). In other words, the point of load on the front end side in the insertion direction is separated from the housing 5 by pressing the point of effort on the rear end side in the insertion direction toward the one surface of the housing 5. The shaft 10 is arranged anterior to the center of the de-latching lever 9 in the insertion direction so that a force acting on the point of load is larger than a force applied to the point of effort.

A wing portion 18 is formed on the de-latching lever 9 to prevent the shaft 10 from being bent by a large force which is applied thereon due to a force generated when the de-latching lever 9 is rotated around the shaft 10 as a rotation shaft.

Meanwhile, an inclined surface 11 inclined toward the front end side in the insertion direction is formed at an effort side end portion of (i.e., 9*a*) the de-latching lever 9 so that an inner surface of a below-described link 13 climbs thereon when the link 13 moves on the rear end side in the insertion direction. The inclined surface 11 is to increase a pressing amount at the effort side end portion 9of the de-latching lever 9 with respect to a travel distance of the link 13.

Referring again to FIG. 2, a compression coil spring 12 for applying a force to the effort side end portion of the de-latching lever 9 in a direction separating from the housing 5 is provided between the de-latching lever 9 and the one surface of the housing 5, and the effort side end portion of the de-latching lever 9 is normally separated from the housing 5 by the compression coil spring 12.

Figure 5:
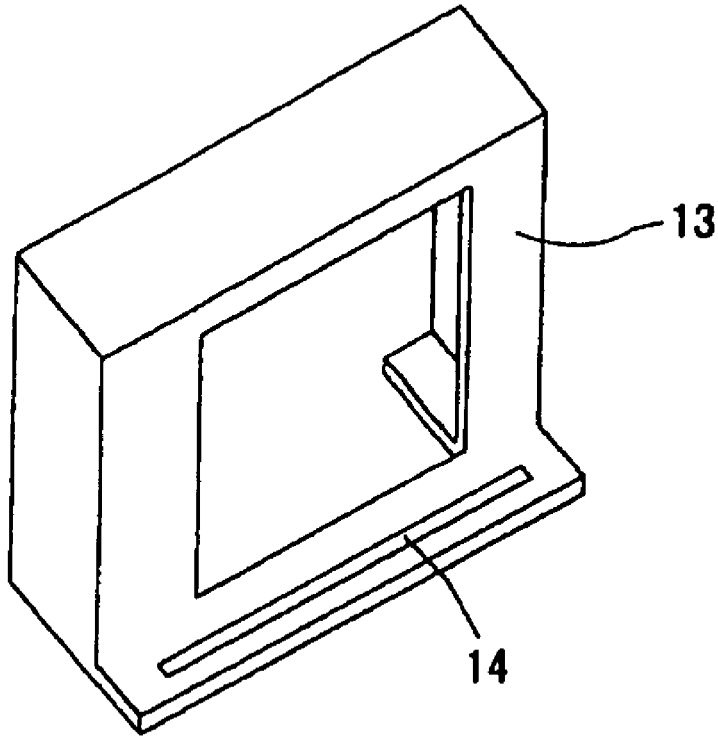
FIG. 5 is a perspective view showing a link.
Figure 6:
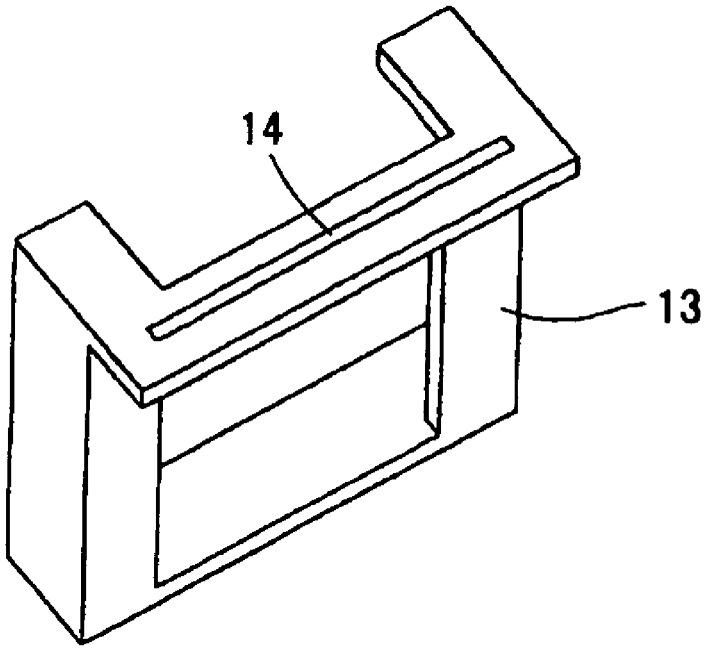
FIG. 6 is a perspective view showing the link.

A frame-shaped link 13 of which inner surface is formed to surround the de-latching lever 9 on the effort side (I.E., REFERENCE NUMERALS 9*b* in FIGS. 3 and 4) is fitted to the housing 5 on the rear end side in the insertion direction so as to be movable in the insertion direction (see FIGS. 5 and 6). A mounting hole 14 for attaching a below-described pull-tab 17 is formed at one end of the link 13. The link 13 and the above described de-latching lever 9 are formed of metal or plastic. It is especially desirable to be formed of a material by which smoothness at a contact portion therebetween is good.

Figure 7:
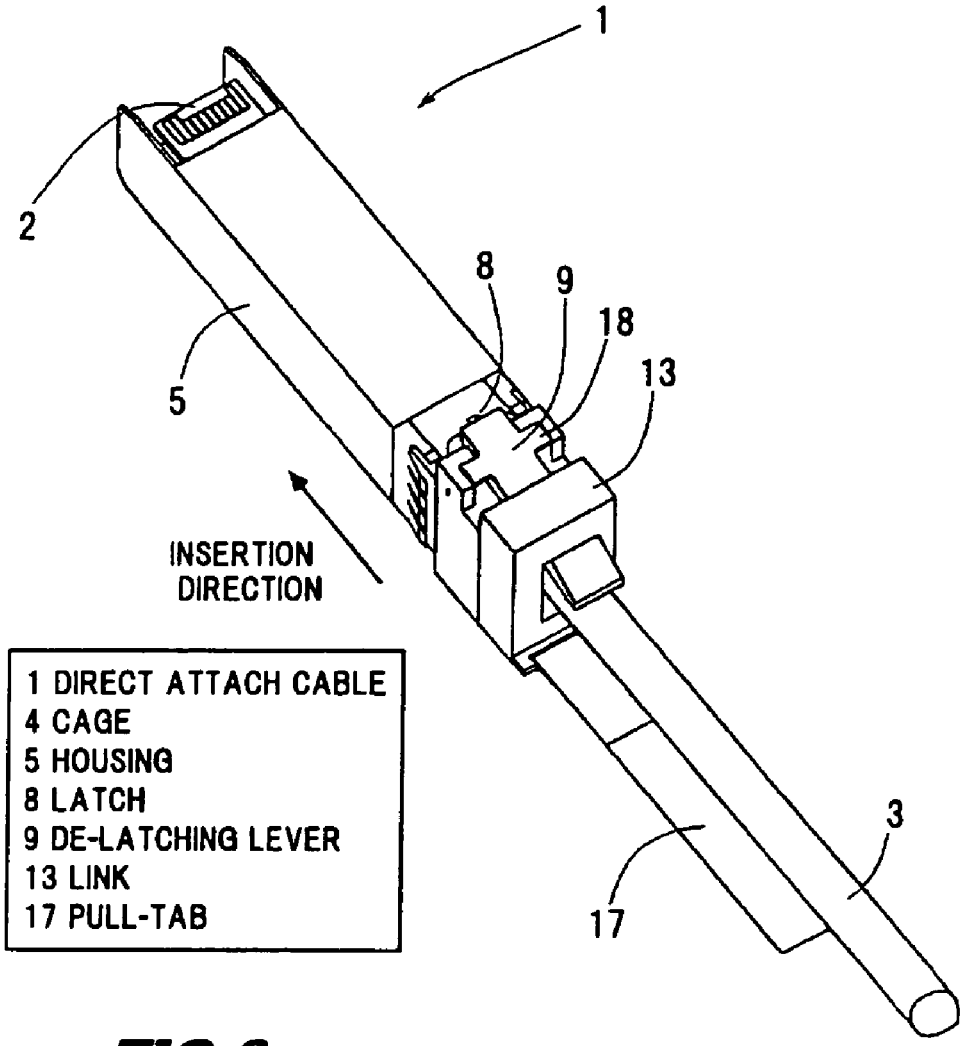
FIG. 7 is a perspective view showing the direct attach cable of FIG. 1 in a state that a pull-tab is being pulled.
Figure 8:
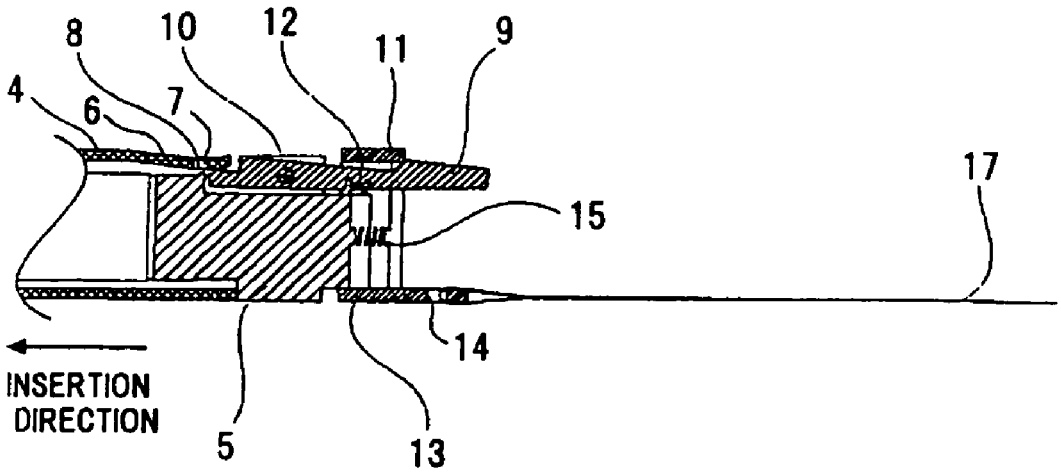
FIG. 8 is a cross sectional view in an insertion direction showing the direct attach cable of FIG. 1 in a state that a latch is de-latched from an engaging portion.

As shown in FIGS. 7 and 8, when the link 13 is moved on the rear end side of the housing 5 in the insertion direction, the end portion of the de-latching lever 9 on the effort side is pressed toward the housing 5 and the end portion on the load side is separated from the housing 5, and this force pushes up the plate spring 6.

An extension coil spring 15 for applying a force in a direction to make the link 13 approach the housing 5 is provided between the link 13 and an end surface of the housing 5 on the rear end side in the insertion direction. The link 13 is normally deeply fitted to the housing 5 by the extension coil spring 15.

The extension coil springs 15 are symmetrically arranged on an end surface of the housing 5 on the rear end side in the insertion direction along a direction parallel to the one surface of the housing 5 so as to sandwich the cable 3. This allows the surface area for arranging the extension coil springs 15 to be large, thus, a spring having a large diameter can be used as the extension coil spring 15. The contact area between the extension coil spring 15 and the link 13 and between the extension coil spring 15 and the housing 5 are large by using the spring having a large diameter, hence, misalignment of the extension coil spring 15 can be prevented and it is possible to stably transmit the force of the link 13 to the de-latching lever 9.

Figure 9:
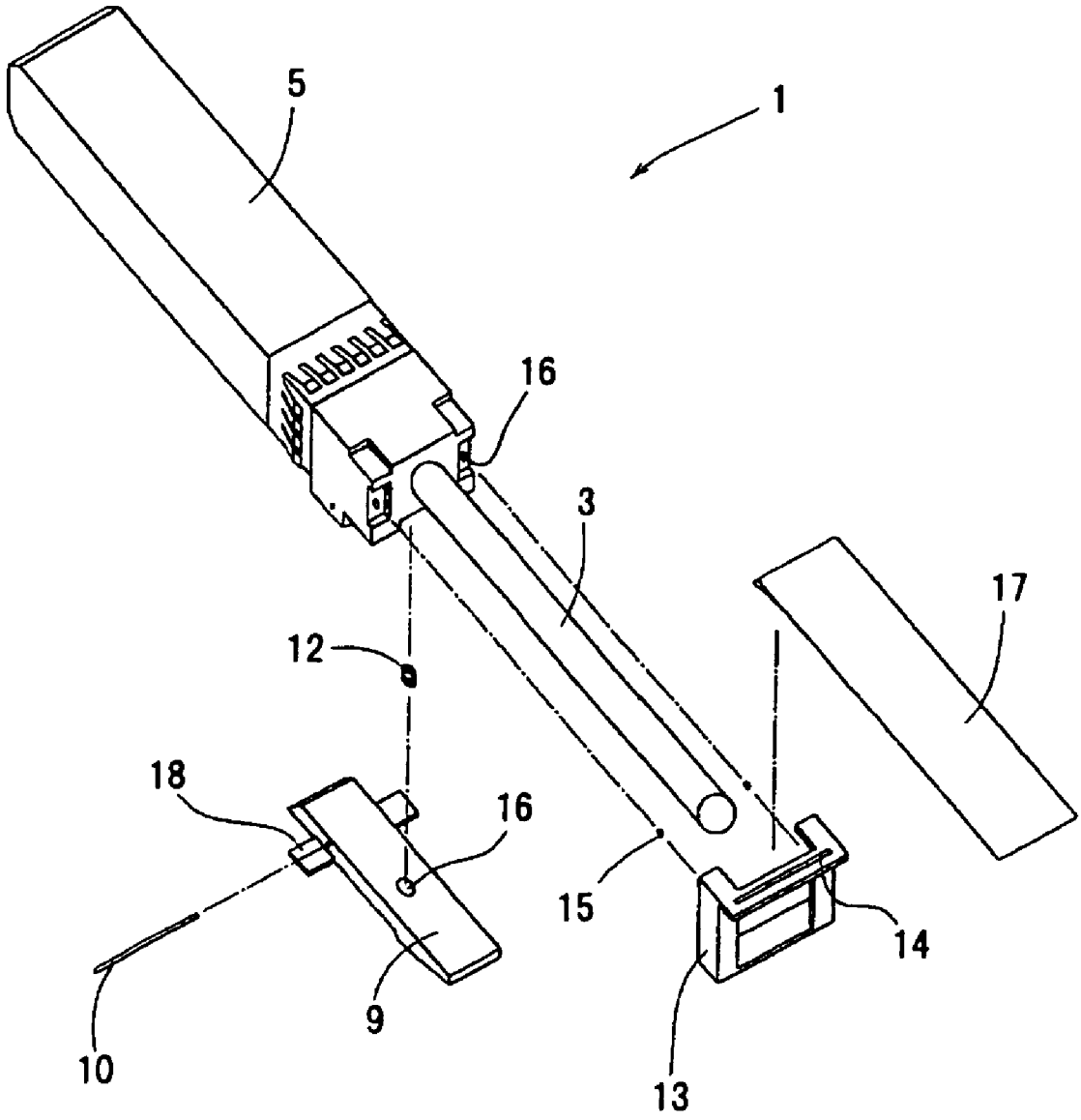
FIG. 9 is an exploded view showing the direct attach cable of FIG. 1.
Figure 10:
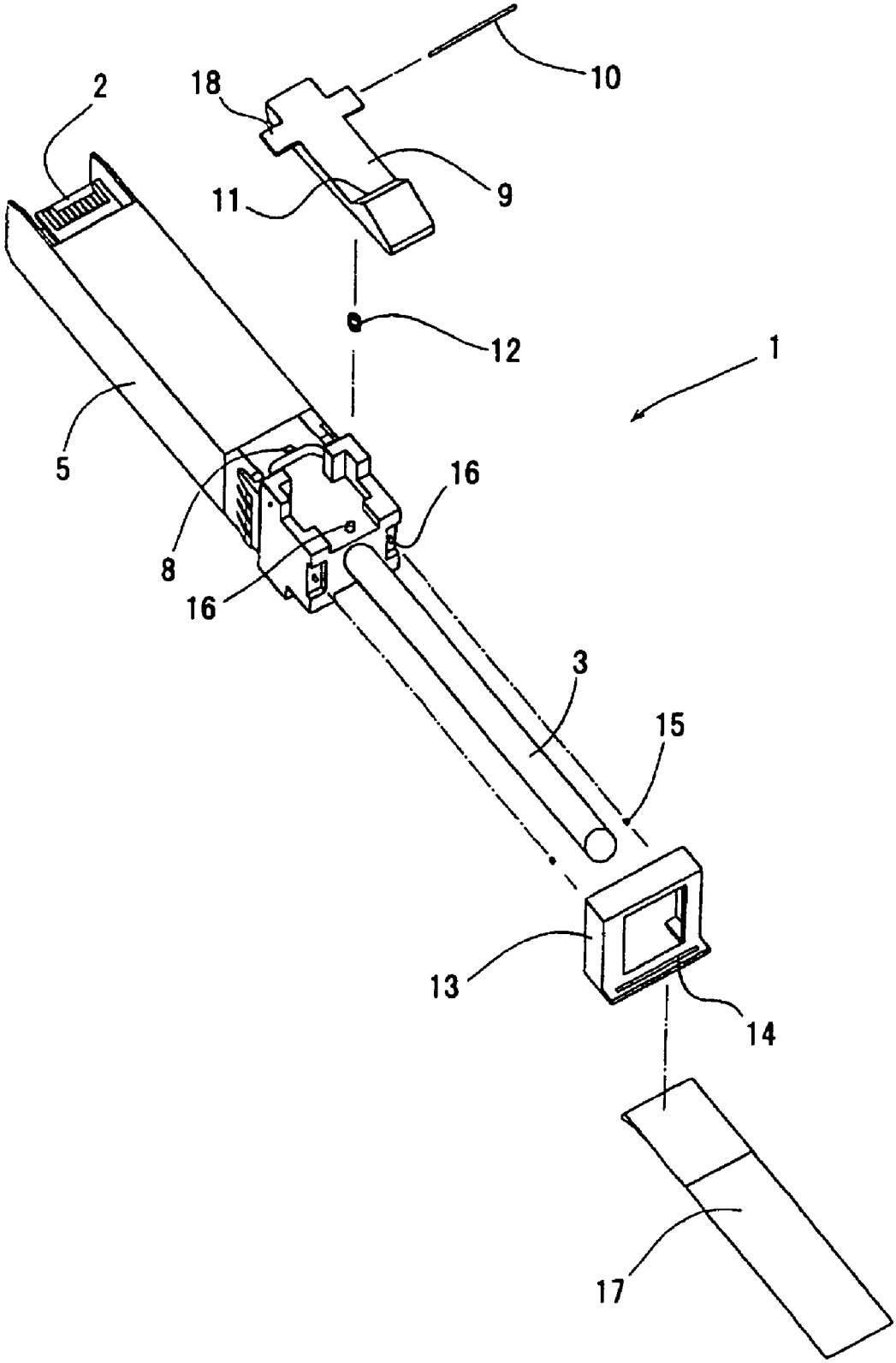
FIG. 10 is an exploded view showing the direct attach cable of FIG. 1.

As shown in FIGS. 9 and 10, the extension coil springs 15 and the above described compression coil spring 12 are each supported by a protruding portion 16 to prevent misalignment thereof.

In general, the cages 4 are often arranged in high density and gaps between the cages 4 are narrow in this case, and it is thereby difficult to pull the link 13 by fingers (to move on the rear end side in the insertion direction). Therefore, a long pull-tab 17 for moving the link 13 toward the rear end side of the housing 5 in the insertion direction is attached to the link 13.

Next, a mechanism of the direct attach cable 1 will be described.

For connecting the direct attach cable 1 to a device, the housing 5 on the front end side of the direct attach cable 1 is inserted into the cage 4 provided on the device and the paddle card 2 in the housing 5 is inserted into a receiving connector of the cage 4, thereby electrically connecting to a connecting terminal of the device. The latch 8 formed on the one surface of the housing 5 is engaged with the engaging portion 7 of the plate spring 6 provided on the cage 4 during the insertion.

As a result, the direct attach cable 1 is connected to the device and it is possible to prevent the housing 5 from being accidentally pulled out from the cage 4.

The pull-tab 17 is pulled in order to detach the direct attach cable 1 from the device. This makes the inner surface of the link 13 climb on the inclined surface 11 of the de-latching lever 9, the effort side end portion of the de-latching lever 9 is pressed in a direction approaching the housing 5 and the plate spring 6 is pushed up. When the plate spring 6 is pushed up in the extent that the engagement between the latch 8 and the engaging portion 7 is released, the housing 5 is pulled out from the cage 4 by a force pulling the pull-tab 17.

When the housing 5 is pulled out from the cage 4, the de-latching lever 9 and the link 13 are returned to the initial position by the compression coil spring 12 and the extension coil spring 15.

As described above, in the direct attach cable 1 of the present embodiment, pulling the pull-tab 17 results in pulling the link 13. At this time, the pulled link 13 presses the point of effort of the de-latching lever 9 toward the housing 5, and a force larger than the pressing force is applied to the point of load by the de-latching lever 9 due to the principle of leverage. This allows the force pulling the pull-tab 17 to be smoothly transmitted, and it is thereby possible to provide a stable de-latched state.

In addition, since it is possible to de-latch and to pull out only by pulling the pull-tab 17, it is very simple. Furthermore, the cable 3 does not mechanically interfere with the de-latching lever 9.

In addition, the touch during latching and de-latching work can be obviously felt by a hand by selecting spring constants of the compression coil spring 12 and the extension coil spring 15. Therefore, it is possible to provide a sense of security when using the direct attach cable 1.

EXAMPLE

Figure 11:
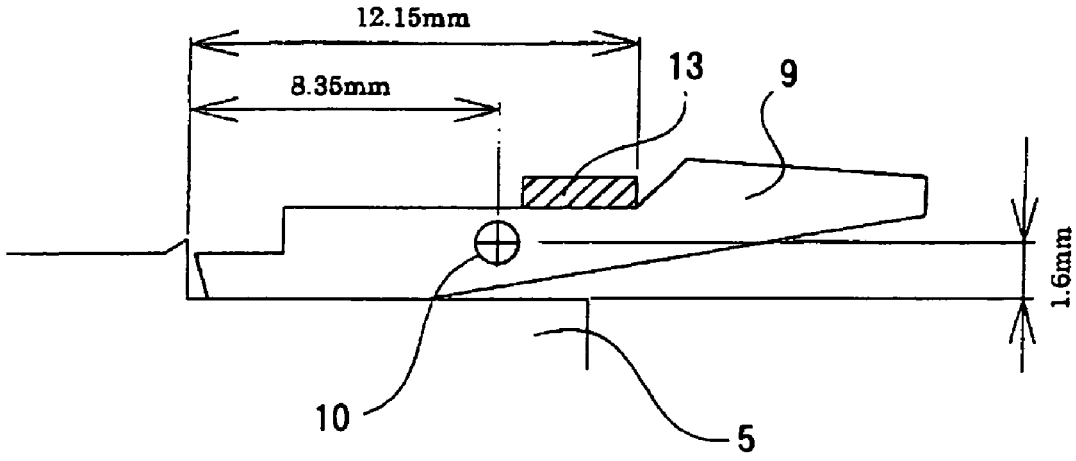
FIG. 11 is a view for showing a dimension of the direct attach cable used in Example.
Figure 12:
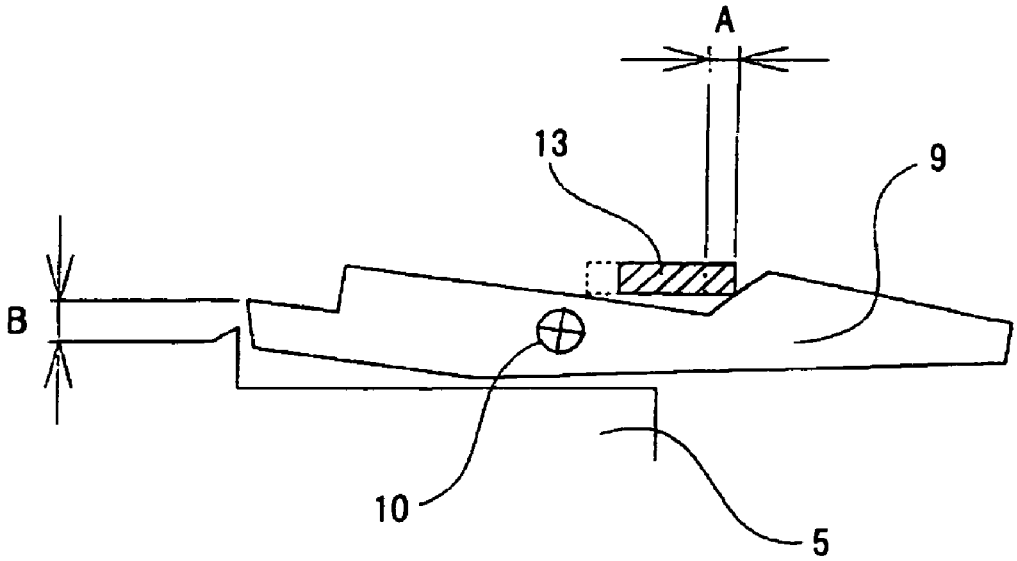
FIG. 12 is a view for showing a dimension of the direct attach cable used in Example.
Figure 13:
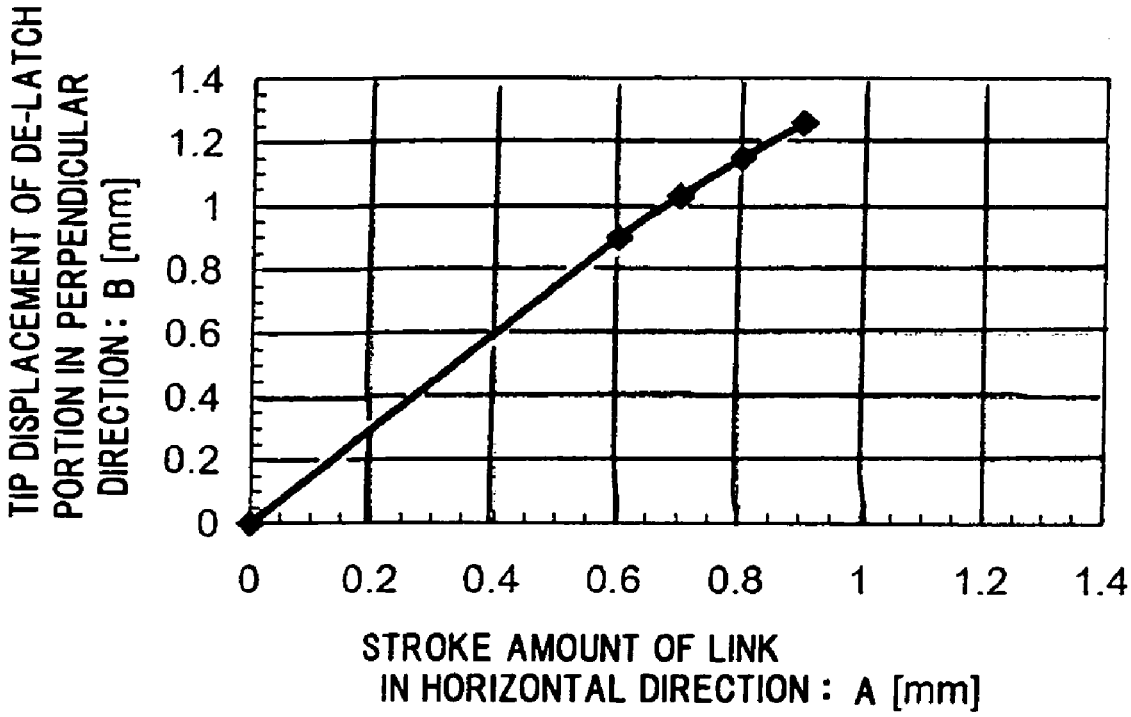
FIG. 13 is a view showing results of Example.

Using the direct attach cable 1 having a size shown in FIGS. 11 and 12, the travel distance of the pull-tab 17, i.e., a tip (an end portion on the load side) displacement B of the de-latching lever 9 in a vertical direction with respect to a stroke amount A of the link 13 in a horizontal direction, was measured. FIG. 13 shows the results.

As shown in FIG. 13, the tip displacement B of the de-latching lever 9 on the load side is large relative to the stroke amount A of the link 13, and it was possible to largely push up the plate spring 6 with a small force.

As described above, in the direct attach cable 1 of the invention, it was possible to provide a sufficiently stable de-latched state by a force pulling out the housing 5.

Although the invention has been described with respect to the specific embodiment for complete and clear disclosure, the appended claims are not to be therefore limited but are to be construed as embodying all modifications and alternative constructions that may occur to one skilled in the art which fairly fall within the basic teaching herein set forth.

What is claimed is:

1. A direct attach cable, comprising:

a cable that an end portion thereof is connected to a paddle card;

a housing formed to store the paddle card and the end portion of the cable and to be insertable into and extractable from a cage as a connection target of the paddle card, the housing having a square cross section in a direction perpendicular to an insertion direction;

a latch formed into a wedge shape protruding on one surface of the housing on a rear end side in the insertion direction and engaged with an engaging portion of a plate spring provided on the cage when the housing is inserted in the cage;

a de-latching lever in a lever shape for releasing the engagement between the latch and the plate spring, the de-latching lever being provided posterior to the latch of the housing in the insertion direction and pushing up the plate spring to disengage the engaging portion of the plate spring from the latch;

a link formed in a frame shape so as to be fitted to the housing on the rear end side in the insertion direction and so that an inner surface thereof surrounds the de-latching lever on an effort side, the link pushing up the plate spring via the de-latching lever by moving toward the rear end side in the insertion direction; and a pull-tab for moving the link on the rear end side of the housing in the insertion direction.

2. The direct attach cable according to claim 1, wherein the de-latching lever comprises an inclined surface inclined toward a front end side in the insertion direction at an effort side end portion thereof, and the inner surface of the link climbs on the inclined surface of the de-latching lever by movement of the pull-tab toward the rear end side in the insertion direction, thereby pushing the effort side end portion of the de-latching lever in a direction coming close to the housing and pushing up the plate spring.

3. The direct attach cable according to claim 1, further comprising:

a compression coil spring for applying a force to an effort side end portion of the de-latching lever in a direction going away from the housing, the compression coil spring being provided between the de-latching lever and the one surface of the housing.

4. The direct attach cable according to claim 1, further comprising:

an extension coil spring for applying a force to the link in a direction coming close to the housing, the extension coil spring being provided between the link and an end surface of the housing on the rear end side in the insertion direction.

5. The direct attach cable according to claim 4, wherein the extension coil springs are symmetrically arranged on the end surface of the housing on the rear end side in the insertion direction along a direction parallel to the one surface of the housing so as to sandwich the cable.

6. The direct attach cable according to claim 2, wherein the de-latching lever further comprises a rotation shaft that is arranged anterior to a center of the de-latching lever in the insertion direction such that a force acting on a point of load is larger than a force applied to the point of effort.

* * * * *